US008292205B2

(12) United States Patent
Clouser et al.

(10) Patent No.: US 8,292,205 B2
(45) Date of Patent: Oct. 23, 2012

(54) TABLET CRUSHER

(75) Inventors: Doug Clouser, Galloway, OH (US); Gary L. Sharpe, Naples, FL (US)

(73) Assignee: Health Care Logistics, Inc., Circleville, OH (US)

( * ) Notice: Subject to any disclaimer, the term of this patent is extended or adjusted under 35 U.S.C. 154(b) by 0 days.

(21) Appl. No.: 13/195,968

(22) Filed: Aug. 2, 2011

(65) Prior Publication Data

US 2012/0187229 A1 Jul. 26, 2012

(51) Int. Cl.
*B02C 19/00* (2006.01)

(52) U.S. Cl. ..... 241/30; 241/270; 241/DIG. 27

(58) Field of Classification Search ..... 241/30, 241/270, DIG. 27
See application file for complete search history.

(56) References Cited

U.S. PATENT DOCUMENTS 6,059,209 A * 5/2000 Barson ..... 241/168
7,364,102 B2 * 4/2008 Engel et al. ..... 241/169
7,413,137 B2 * 8/2008 Donovan ..... 241/168
* cited by examiner

*Primary Examiner* — Mark Rosenbaum
(74) *Attorney, Agent, or Firm* — Standley Law Group LLP

(57) ABSTRACT

A device for crushing one or more tablets and method for using the same are disclosed. The device preferably contains a lower body portion and upper body portion which assemble to define a cavity between the two portions. The cavity has a floor which may define an anvil. At least one opening is placed within the cavity to accept a tablet. A platen body may be adapted to travel along a substantially vertical axis between a closed and open position and may be guided along a rear vertical wall of the cavity. A pinion is preferably placed on an elongate member and operatively engages with a rack placed on the platen body such that movement of the elongate member is translated to the platen body. A crushing surface may be placed on the platen body and is preferably parallel to the anvil. The crushing surface and anvil may be placed at an oblique angle relative to the vertical axis of travel for the platen body. The platen body may contain a top surface which contacts a corresponding surface on the elongate member when the platen body is in the closed position so as to apply a hammering force to the tablet.

18 Claims, 3 Drawing Sheets

TABLET CRUSHER

CROSS-REFERENCE TO RELATED APPLICATIONS

This application claims priority to U.S. Application No. 61/369,964, filed on Aug. 2, 2010, herein incorporated by reference in its entirety.

TECHNICAL FIELD

The present invention relates generally to tablet and pill crushing devices.

BACKGROUND OF THE ART

It is a simple combination of medical advances and demographics that has caused a great increase in the need for crushing pre-formed medication tablets for proper ingestion by patients having diminished swallowing capabilities. At one point, medications, such as "headache powders" were dispensed in a powdered form. As the technology of the pharmaceutical industry improved, it became possible to form very carefully measured dosages of the medications in a compressed, pre-formed tablet. While the tablet is extremely useful to the pharmaceutical manufacturer in dispensing precise numbers of dosages that can be handled in a clean and efficient manner, the tablet may present significant difficulties to the patient, especially the elderly, the weakened and those with swallowing difficulties. As the number of medications increases, the number of patients who have difficulty with swallowing has also increased.

It is desirable to provide a device where a smooth and quiet crushing action can be imparted to a variety of sizes and shapes of tablets, without requiring an impact force. The crushing should result in a small average particle size, preferably occurring in a disposable container, to retain and dispense the entire dosage in a manner that does not breach the container or cause cross contamination when the device is used with different medications. It is also desirable to provide clear and unobstructed access to all of the crushing surfaces, for ease of cleaning when necessary. It is also desirable to provide a device that can accommodate pill containers that are different from the conventional flat pouches that have been known in the prior art, if and when such different containers are developed.

In the prior art solutions known to the inventor, what appears to be a common element is that a lever action is used between a pair of opposing crushing faces, which are usually referred to as a platen and an anvil. Further, the known prior art solutions seem to position the pill container vertically, a result of which is that a particle that is broken away from the pill, especially in the initial breakage, can fall by gravity out of the field where the most active crushing is occurring. This can result in no further, or secondary, crushing of the particle, with the result of a larger average particle size.

It is therefore an advantage of the embodiments disclosed herein to provide a pill crushing device that provides at least some of the desired objectives.

SUMMARY

These advantages are provided by a tablet crusher as described in more detail in the detailed description and drawings provided herewith.

Other aspects and advantages of the present invention will become apparent from the following detailed description, taken in conjunction with the accompanying drawings, illustrating by way of example the principles of the invention.

BRIEF DESCRIPTION OF THE DRAWINGS

The advantages and other characteristics of the disclosed embodiment will better understood when attention is directed to the accompanying drawings, wherein identical elements are identified with identical reference numerals and wherein.

DETAILED DESCRIPTION OF A PREFERRED EMBODIMENT

Figure 2:
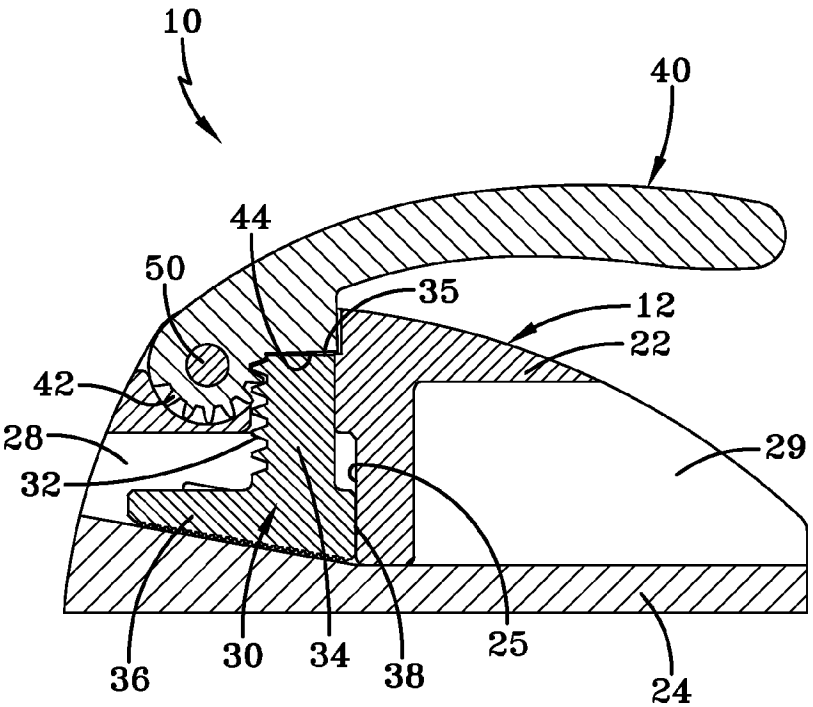
FIG. 2 is a side section elevational view of the FIG. 1 tablet crusher, also in the closed position.

Directing attention to the drawings, and particularly to FIG. 1, an embodiment 10 of a tablet crusher is shown in a front perspective view, and, as will be explained, in a closed condition or position, relative to its operation in crushing tablets, pills and the like. The embodiment 10 generally has a body 12 characterized by a top opening 14, two side openings 16 (only one of which is visible in FIG. 1) and a front opening 18. Side and front openings 16, 18 permit one or more tablets to be crushed to be placed in a crush chamber 20.

Figure 1:
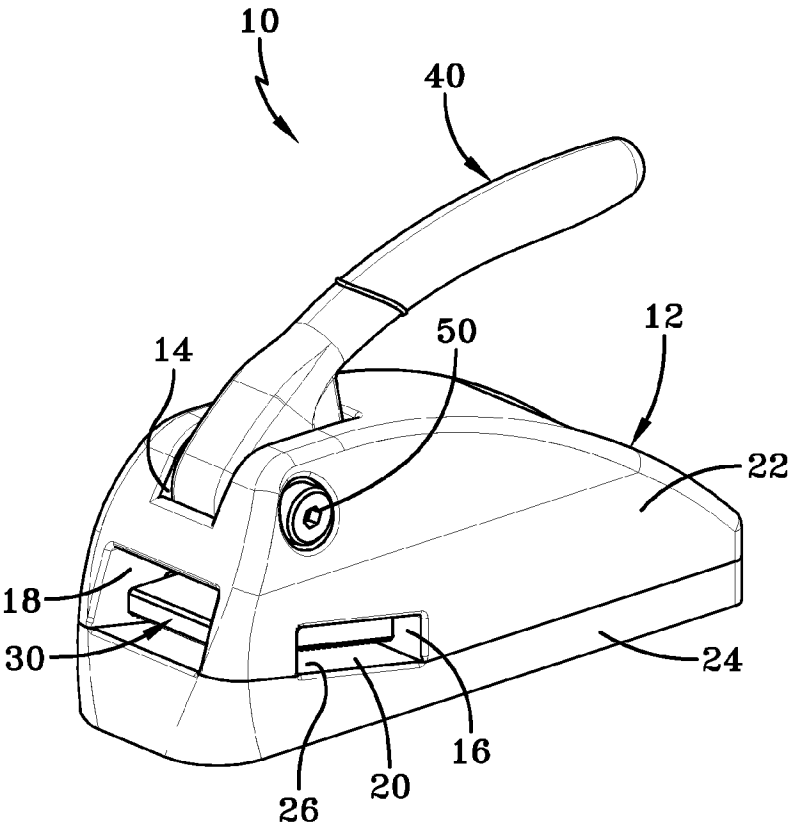
FIG. 1 is a front perspective view of an embodiment of the tablet crusher device, in a closed position.

The embodiment 10 disclosed here has upper and lower body portions 22, 24, which are shown in FIG. 1 in a joined condition. Preferably, upper and lower body portions 22, 24 may be separated from each other, to facilitate cleaning and maintenance of the crushing mechanism located in crush chamber 20. The lower body portion 24 preferably is an elongated, generally rectangular base, with a preferably planar bottom surface, so that a user of the device can place it on a horizontal surface, such as a table, and operate the device. For this reason, many embodiments will be provided with a bottom surface that tends to maximize the contact area with surface on which it is placed. Many embodiments will also be provided with a non-slip and/or cushioning material, the exact composition of which will be readily known to one of skill in the art.

An anvil 26, preferably in the nature of a fixed rigid surface, is positioned on the lower body portion 24, especially in an area thereof that will define a floor of the crush chamber 20. In some lower body portions 24, the anvil 26 will be integrally formed. In other embodiments, the anvil 26 will be a thin but rigid plate, removable from the lower body portion 24. In these latter embodiments, it would be typical, for example, to use the same means that fastens or joins the respective upper and lower body portions 22, 24 to each other to pass through the anvil 26, which would be interposed between the body portions, to fix the position of the anvil relative to the lower body portion and the crush chamber.

Upper body portion 22 provides the respective openings 14, 16, 18, which are all interconnected through crush chamber 20.

Also visible in FIG. 1 is platen body 30. The platen body 30 is arranged for a limited movement in the upper body portion 22, such that the movement of the platen body relative to the anvil 26 changes the volume of the crush chamber 20. A lower surface of the platen body 30 defines a ceiling of crush chamber 20.

A handle 40 is seated is the top opening 14. Pivot means 50, one end of which is visible in FIG. 1, is depicted as a pin that retains the handle 40 in the top opening 14 and defines an axis about which the handle rotates.

Attention is now directed to FIG. 2, which is a section taken through the FIG. 1 device 10 along a front-to-rear centerline. The device 10 is depicted in a first or closed position, in which the lower surface of platen body 30 is as close to the anvil 26 as it normally gets. Although no tablet-containing pouch is shown in FIG. 2, this closed position is how the device 10 would be configured at the end of the crushing action of the device. Upper and lower body portions 22, 24 are clearly shown. The full extent of a first internal cavity 28 of the upper body portion 22, which contains the platen body 30 and the crush chamber 20, is seen more completely than in FIG. 1. A second internal cavity 29, not visible in FIG. 1, is seen in FIG. 2. This second internal cavity 29 is not primarily related to the tablet-crushing functionality of the device 10, but instead provides a storage capacity for a package of the pouches or containers that are used in the tablet-crushing functionality.

Further features of the handle 40 are also seen in FIG. 2. Particularly, the illustrated handle 40 is an elongate member that is generally straight near a first end thereof, that is, an end that is pinned in place by pivot means 50. However, as one moves from this end towards a second end thereof, the handle may adopt a generally curved shape. A pinion 42 is formed on the handle 40 near a first end thereof, and, in the illustrated embodiment, this pinion is arranged such that a surface 44 of the handle operates as a part of the pinion by bearing against a portion of the platen body 30 when the platen body is fully lowered against the anvil 26, as FIG. 2 shows. In the illustrated embodiment, pinion 42 has a central aperture that receives pivot means 50.

Further attention is now directed to platen body 30. The body has two distinguishing portions. The first is rack 32, formed on a vertical portion 34 thereof and operatively engaging pinion 42. A top surface 35 of vertical portion 34 is spatially arranged to engage surface 44 of the handle 40 at the bottom of the handle's range of motion, giving a hammering effect to the end of the crushing motion. The second element of the platen body is the crushing body member 36, of which the lower surface 37 co-acts with anvil 26 to crush tablets placed therebetween. Platen body 30 is generally constrained to vertical motion within the first internal cavity 28 by its peripheral surfaces, including the engagement of rack 32 with pinion 42 and the interaction of a rear surface 38 with a rear surface 25 of the first internal cavity 28. Similarly, side surfaces of the crushing body member 36 co-act with the lateral side walls of the internal cavity 28 to constrain side-to-side movement of the platen body 30.

Figure 4:
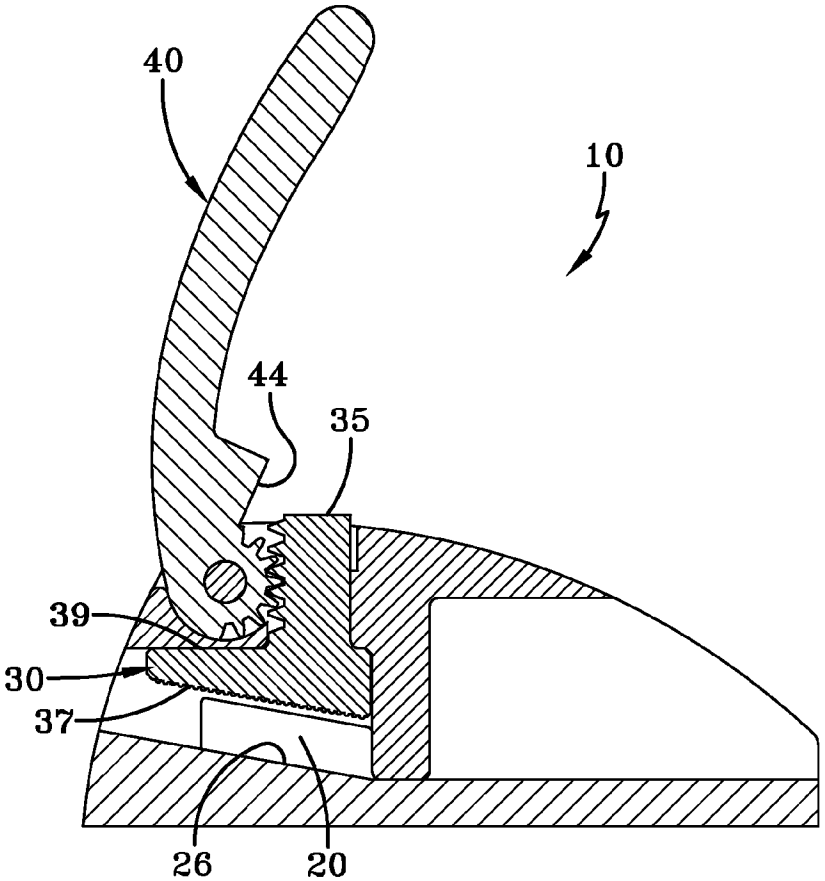
FIG. 4 is a side section elevational view of the FIG. 1 tablet crusher, also in the open position.
Figure 3:
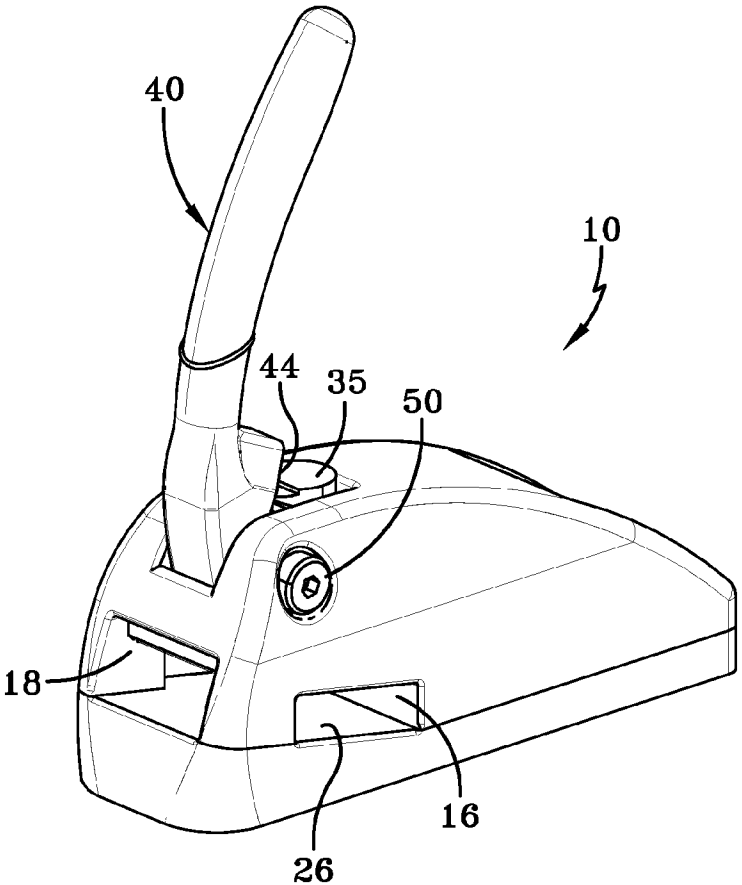
FIG. 3 is a front perspective view of an embodiment of the tablet crusher device, in an open position.

Referring now to FIGS. 3 and 4, the device 10 is depicted with the handle 40 rotated from the closed position of FIGS. 1 and 2 to the fully open position. In this position, the platen body 30 is lifted away from anvil 26 by the interaction of the rack and pinion mechanism. FIGS. 3 and 4 reveal how this movement of the platen body 30 opens up the crush chamber 20 and the access thereto through openings 16, 18. In this open position, a tablet container can be inserted in several different ways. This includes, for example, a situation where a closed cylindrical container in the nature of a drinking straw can be inserted through the side openings 16. If one or more tablets are crushed while contained in this manner, the subsequent use of the container as a drinking straw with water or another liquid may be a very efficient way to deliver the full dosage of the tablets to a patient.

The top surface 35 of rack 32 is notably visible in top opening 14 of FIGS. 3 and 4.

In FIG. 4, abutment of a top surface 39 of the crushing body member 36 against the ceiling of the first internal cavity 28 is shown as a means for limiting the range of angular movement of handle 40 in the open position. As noted with regard to FIG. 2, the angular range of the movement of the handle 40 is limited at the other end, that is, in the closed position, by abutment of at least one of the handle surface 44 against surface 35 or of surface 37 against anvil 26.

Referring to FIGS. 2 and 4, it is notable that the crushing faces of anvil 26 and lower surface 37 of platen body 32 are in parallel relationship to each other at each end of their motion. It is clear from the disclosed mechanism that this parallel relationship is maintained throughout the range of the motion. Another feature that may be more easily seen in FIG. 4 is the fixed oblique angle formed between surface 37 and the essentially vertical axis of motion of platen body 30. This feature may also be observed as the fixed angle formed between the anvil 26 and the horizontal lower surface of the lower body portion 24. While there has not been a particular optimization of these respective angles, which are complementary, it is expected that the larger angle should be less than 85°, but probably greater than 70°.

The parallel relationship of anvil 26 and platen surface 37 and the angularity of both provide some important improvements when compared against the prior art crushing devices. In many of the prior art devices, the container is positioned almost vertically, so the crushing force is applied almost horizontally, and pieces may fall by gravity out of the crushing arena. Also, many of these prior art devices use a fulcrum located at the lower end of one of the crushing faces in the crushing mechanism, so the angularity between the faces changes almost constantly. In the present mechanism, the pieces of the tablet generated in the initial crushing action can slide away from the bulk remnants of the tablet, using gravity, but the amount of force exerted by the surface 37 remains effectively constant across the surface, so these pieces remain "in play" so to speak with regard to being further comminuted.

In the illustrated embodiment 10, the opposing faces of anvil 26 and platen body 30 have smooth planar surfaces that are effectively parallel to each other and can approach each other to within a predetermined arbitrarily small distance. It may be useful in some situations to provide curvature or serrations to one or both crushing surfaces.

Figure 5:
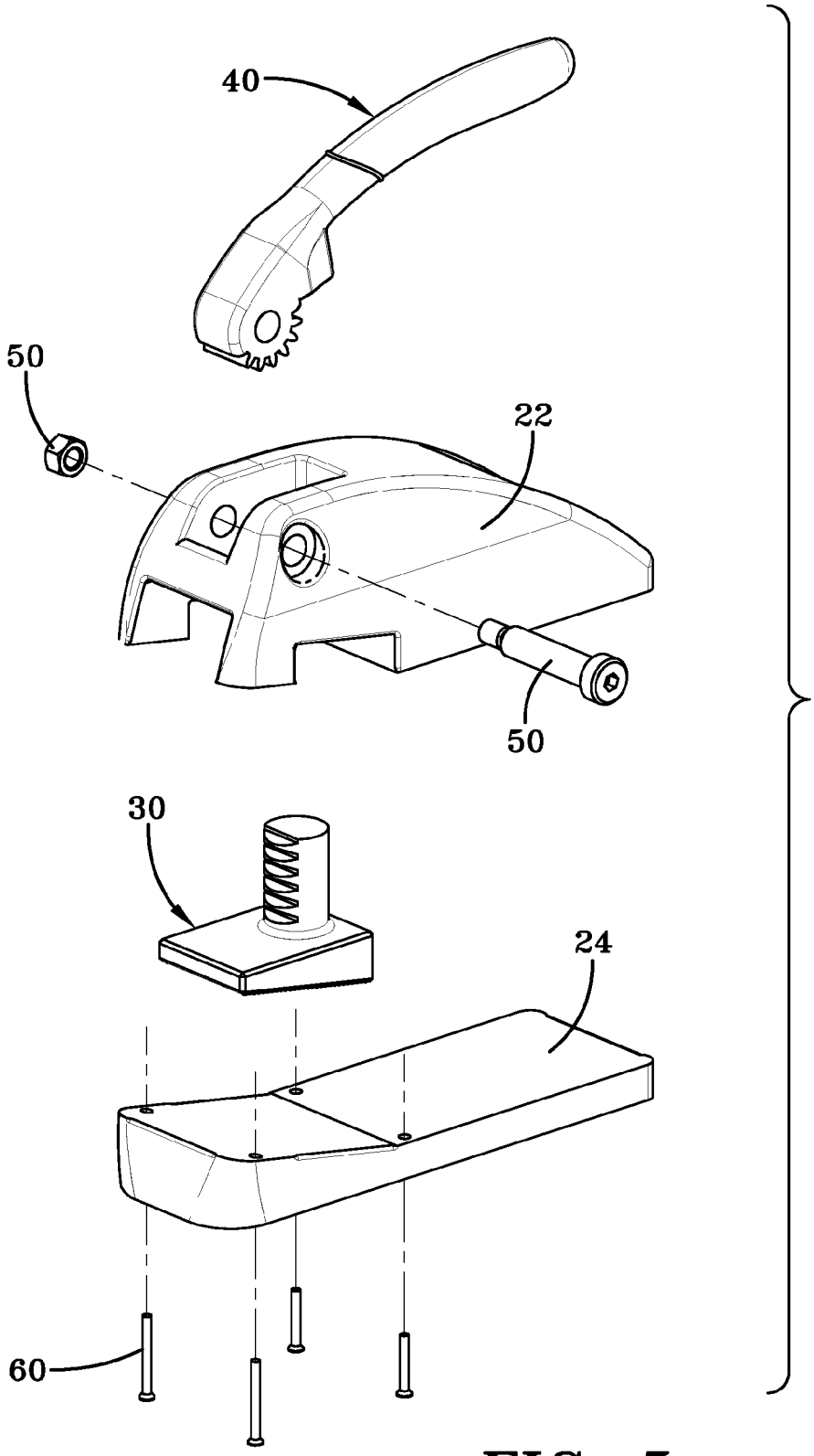
FIG. 5 is an exploded perspective view of the FIG. 1 embodiment.

Referring finally to FIG. 5, a method of assembling the device 10 is shown in an exploded view that also discloses structural detail not visible in the prior views. Notable in this drawing beyond features that have been previously described are the fasteners 60 that secure the respective upper and lower body portions 22, 24 to form body 20. As noted above, if anvil 26 is a removable piece that sits atop the lower body portion, these fasteners 60 can hold the anvil in place as they pass through holes that are positioned in the anvil, and preferably at the corners of the anvil, as at least two of the holes in FIG. 5 show. Central aperture 52 in the pinion portion of handle 40 is observable in FIG. 5.

While the person of skill in this art will be readily able to determine appropriate materials for the individual parts, it is expected that at least certain parts, especially anvil 26 and platen body 30, will be formed from metal, due to the mass provided thereby. Accordingly, the pinion would be preferably comprised of metal.

While the embodiments disclosed describe the best modes known to the inventor at the time of filing, the scope of the invention is not to be limited to only the embodiments disclosed herein.

What is claimed is:

1. A device for crushing one or more tablets, the device comprising:

a lower body portion having a substantially rectangular base and a planar bottom surface;

an upper body portion placed atop the lower body portion to create a first internal cavity having
at least one opening for accepting a tablet,
a substantially vertical rear wall, and
an anvil;

a platen body adapted to travel along a substantially vertical axis between an open and closed position and having
a lower crushing surface parallel to the anvil surface where the crushing surface and the anvil are positioned at an oblique angle relative to the vertical axis of travel of the platen body,
a vertical rack, and
a rear surface adapted to translate along the rear wall as the platen body travels between the open and closed positions;

a pivot means on the upper body portion and placed above the internal cavity;

an elongate member adapted to pivot about the pivot means; and a pinion on the elongate member and operatively engaged with the vertical rack so that movement of the elongate member causes the platen body to move vertically between the open and closed positions.

2. The crushing device of claim 1 further comprising:

a second internal cavity defined between the lower body and upper body.

3. The crushing device of claim 1 wherein:

the pivot means comprises a pin.

4. The crushing device of claim 1 further comprising:

non-slip material on the bottom surface.

5. The crushing device of claim 1 further comprising:

corresponding surfaces on the platen body and elongate member which provide a hammering force from the elongate member to the platen body.

6. The crushing device of claim 1 further comprising:

a top surface on the platen body which contacts the elongate member when the platen body is in the closed position.

7. The crushing device of claim 1 wherein:

the oblique angle between the crushing surface and the vertical axis of travel of the platen body is between 70 degrees and 85 degrees.

8. The crushing device of claim 1 wherein:

the internal cavity contains a front opening and a pair of opposing side openings.

9. The crushing device of claim 1 wherein:

the pinion, platen body, and anvil are comprised of metal.

10. A device for crushing one or more tablets, the device comprising:

a lower body portion having a substantially rectangular base and a planar bottom surface;

an upper body portion placed atop the lower body portion;

a crush chamber between the upper and lower body portions and having a floor and a substantially vertical rear wall;

an opening in the crush chamber for accepting a tablet;

an anvil surface on the floor of the crush chamber;

a platen body adapted to travel along a substantially vertical axis between an open and closed position and having
a lower crushing surface parallel to the anvil surface,
a vertical rack, and
a top surface;

a pivot means on the upper body portion and placed above the crush chamber;

an elongate member adapted to pivot about the pivot means; and a pinion on the elongate member and operatively engaged with the vertical rack so that movement of the elongate member causes the platen body to move vertically between the open and closed positions; and a surface positioned on the elongate member so as to contact the top surface of the platen body only when the platen body is in the closed position.

11. The crushing device of claim 10 further comprising:

an internal storage cavity defined between the lower body and upper body.

12. The crushing device of claim 10 wherein:

the pivot means comprises a pin.

13. The crushing device of claim 10 further comprising:

non-slip material on the bottom surface.

14. The crushing device of claim 10 wherein:

the angle between the crushing surface and the vertical axis of travel of the platen body is between 70 degrees and 85 degrees.

15. The crushing device of claim 10 wherein:

the crush chamber contains a front opening and a pair of opposing side openings.

16. The crushing device of claim 10 wherein:

the crushing surface and anvil surface are comprised of metal.

17. A method for using the device of claim 10 to crush at least one tablet, comprising the steps of:

pivoting the elongate member to place the platen body in the open position;

inserting the tablet into the opening of the crush chamber;

placing the tablet atop the anvil surface;

pivoting the elongate member to cause the platen body to move towards the closed position; and crushing the tablet.

18. The method of claim 17 wherein:

the step of crushing the tablet is performed by transferring force from the surface on the elongate member directly to the top surface of the platen body.

* * * * *